US008393168B2

(12) United States Patent
Lee et al.

(10) Patent No.: US 8,393,168 B2
(45) Date of Patent: Mar. 12, 2013

(54) REFRIGERATOR AND OPERATING METHOD THEREOF

(75) Inventors: Seung Lee, Gwangsan-gu (KR); Young-woon Kwon, Gwangsan-gu (KR); Se-jin Sohn, Seoul (KR); Jin-kyu Jung, Gwangsan-gu (KR); Yong-seok Kim, Gwangsan-gu (KR); Man-ki Kwon, Nam-gu (KR); Sang-ho Byeon, Gwangsan-gu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 825 days.

(21) Appl. No.: 12/458,838

(22) Filed: Jul. 23, 2009

(65) Prior Publication Data

US 2010/0145524 A1 Jun. 10, 2010

(30) Foreign Application Priority Data

Dec. 8, 2008 (KR) ..... 10-2008-0124183

(51) Int. Cl.
*F25B 49/00* (2006.01)
*F25D 23/12* (2006.01)
*G05D 23/00* (2006.01)

(52) U.S. Cl. ..... 62/126; 62/252; 700/299

(58) Field of Classification Search ..... 62/126, 62/252; 700/275, 299
See application file for complete search history.

(56) References Cited

U.S. PATENT DOCUMENTS 6,463,752 B2 * 10/2002 Mandel et al. ..... 62/382
2002/0069652 A1 * 6/2002 Roh et al. ..... 62/126
2005/0091063 A1 * 4/2005 Bergemann et al. ..... 704/275

FOREIGN PATENT DOCUMENTS

JP 04241800 A * 8/1992

* cited by examiner

*Primary Examiner* — Chen Wen Jiang
(74) *Attorney, Agent, or Firm* — Staas & Halsey LLP

(57) ABSTRACT

Disclosed is a method of operating a refrigerator, including: providing a plurality of usage environment information which includes national information; selecting the usage environment information corresponding to a nation or region where the refrigerator is used among the plurality of usage environment information; and controlling operation of the refrigerator based on the selected usage environment information.

21 Claims, 6 Drawing Sheets

| NATIONAL INFORMATION | LANGUAGE INFORMATION | USAGE CHARACTERISTICS IN EACH NATION | USAGE CHARACTERISTICS ACCORDING TO STANDARD ORGANIZATION |
|---|---|---|---|
| KOREA | KOREAN | KIMCHI | A, B |
| USA | ENGLISH | FOOD | A, B, C |
| FRANCE | FRENCH | VACATION | A, C |
| CHINA | CHINESE | VEGETABLES | A, B |
| GERMANY | GERMAN | VACATION | A, C |

REFRIGERATOR AND OPERATING METHOD THEREOF

CROSS-REFERENCE TO RELATED APPLICATIONS

This application claims priority from Korean Patent Application No. 10-2008-0124183, filed on Dec. 8, 2008 in the Korean Intellectual Property Office, the disclosure of which is incorporated herein by reference.

BACKGROUND

1. Field

The present invention generally relates to a refrigerator which can set an operational condition according to environmental conditions and an operating method thereof.

2. Description of the Related Art

In general, a refrigerator includes a storage room in which food is stored at low temperature. The refrigerator includes a cooling cycle to supply cool air to the storage room. The cooling cycle includes a compressor, a condenser and an evaporator.

The refrigerator is widely used throughout the world. Operational conditions of the refrigerator, such as a temperature range in the storage room, may vary according to the nation where the refrigerator is used.

SUMMARY

Accordingly, it is an aspect of the present invention to provide a refrigerator which may vary operating conditions according to the environment.

Additional aspects and/or advantages will be set forth in part in the description which follows and, in part, will be apparent from the description, or may be learned by practice of the invention.

The foregoing and/or other aspects may be achieved by providing a method of operating a refrigerator, including: providing a plurality of usage environment information which comprises national information; selecting the usage environment information corresponding to a nation or region where the refrigerator is used among the plurality of usage environment information; and controlling operation of the refrigerator based on the selected usage environment information.

The refrigerator may include a display, and the providing the usage environment information may include displaying the usage environment information on the display.

The usage environment information may further include one of language information corresponding to the national information, usage characteristics in each nation and usage characteristics according to each standard organization.

The usage environment information may further include language information corresponding to the national information, usage characteristics in each nation and usage characteristics according to each standard organization.

The selecting the usage environment information may include selecting at least one of the language information, the usage characteristics in each nation and the usage characteristics according to each standard organization, after selecting the national information.

The language information may be provided as language information after selecting the national information.

The usage environment information may be selected by a user or a manufacturer of the refrigerator.

The refrigerator may include a body cabinet which forms a storage room, and the controlling operation of the refrigerator includes controlling operation of the refrigerator to correspond to a temperature range in the storage room preset corresponding to the usage characteristics in each nation.

The controlling operation of the refrigerator may include controlling operation of the refrigerator to correspond to standards of electromagnetic waves, noises and power consumption preset corresponding to the usage characteristics according to each standard organization.

According to another exemplary embodiment of the present invention, there is provided a refrigerator including: a memory unit which stores a plurality of usage environment information which includes national information; and a selection unit which provides the plurality of usage environment information stored in the memory unit, and through which at least one of the plurality of the usage environment information is selected.

The refrigerator further includes an operational unit and a controller which controls the operational unit, and the controller may control the operational unit based on the usage environment information selected through the selection unit.

The usage environment information may further include one of language information corresponding to the national information, usage characteristics in each nation and usage characteristics according to each standard organization.

The usage environment information may further include language information corresponding to the national information, usage characteristics in each nation and usage characteristics according to each standard organization.

After selecting the national information, at least one of the language information, usage characteristics in each nation and usage characteristics according to each standard organization may be selected.

The language information may be provided as language information after selecting the national information.

The refrigerator further includes a body cabinet which forms a storage room, and the controller may control the operational unit to correspond to a temperature range in the storage room preset corresponding to the usage characteristics in each nation.

The controller may control the operational unit to correspond to standards of electromagnetic waves, noises and power consumption preset corresponding to the usage characteristics according to each standard organization.

The selection unit may include: a display which displays the plurality of usage environment information which is stored in the memory unit; and an input part through which one of the plurality of usage environment information displayed on the display is selectively inputted.

The usage environment information may be selected by a user or a manufacturer of the refrigerator.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF EMBODIMENTS

Figure 1:
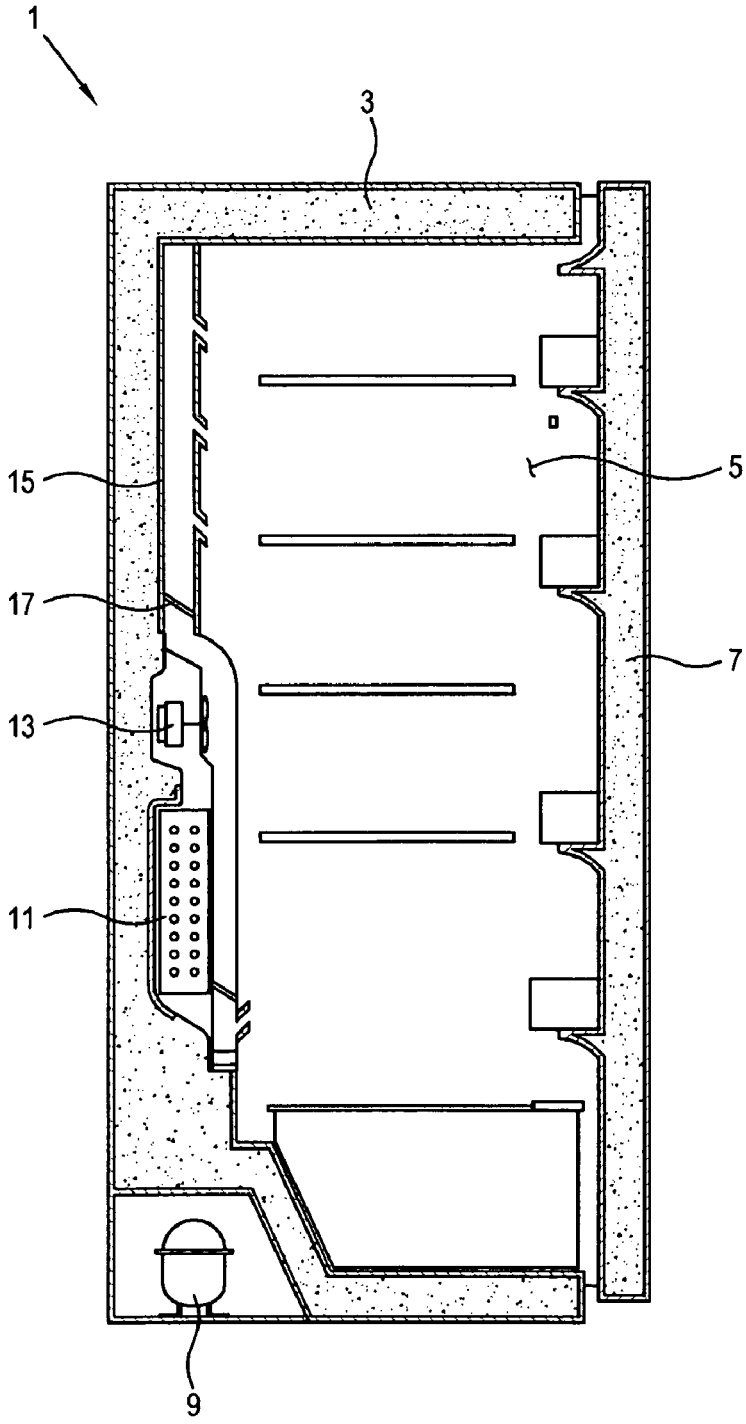
FIG. 1 is a sectional view of a refrigerator according to embodiments of the present invention.

Reference will now be made in detail to the embodiments of the present invention, examples of which are illustrated in the accompanying drawings, wherein like reference numerals refer to like elements throughout. The exemplary embodiments are described below so as to explain the present invention by referring to the figures. Redundant description to different embodiments may be omitted as necessary.

In the present description, a refrigerator of a side-by-side type is exemplified, but the embodiment of the present invention may include other types of refrigerators.

Figure 2:
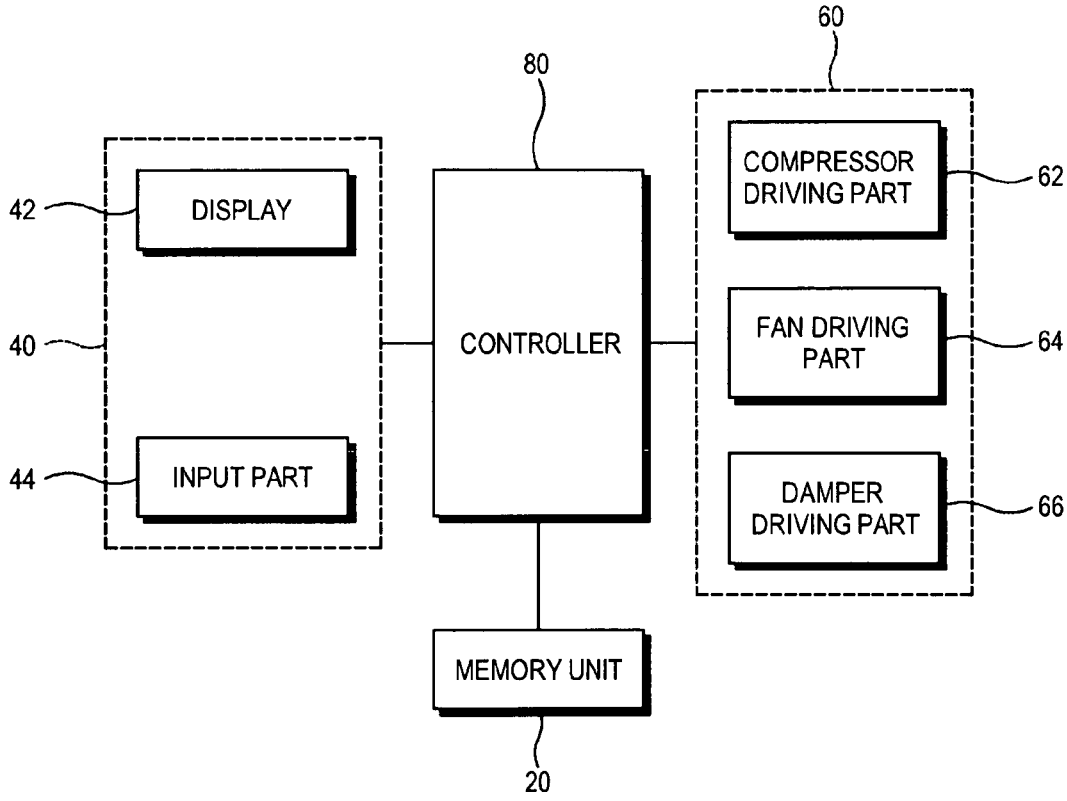
FIG. 2 is a control block diagram of a refrigerator according to a first exemplary embodiment of the present invention.

As shown in FIGS. 1 and 2, a refrigerator 1 according to an exemplary embodiment of the present invention includes a body cabinet 3 which forms a storage room 5; a memory unit 20 which stores usage environment information; a selection unit 40 through which the usage environment information is selected; an operational unit 60 which operates the refrigerator 1 according to the usage environment information; and a controller 80 which controls the operational unit 60.

In the body cabinet 3 is formed the storage room 5. The storage room 5 includes a freezing compartment and a refrigerating compartment. Further, in the body cabinet 3 is formed a door 7 which opens and closes the storage room 5.

In the body cabinet 3 is provided a cooling cycle which includes a compressor 9, a condenser (not shown), an evaporator 11 and a capillary tube (expansion valve, not shown). Further, a cool air duct 15 which forms a flow path of cool air generated from the evaporator 11, a fan 13 which blows the cool air in the cool air duct 15 to the storage room 5, and a damper 17 which is installed in the cool air duct 15 and selectively allows or blocks introduction of the cool air to the storage room 5 are provided in the body cabinet 3.

In the memory unit 20 is stored a plurality of usage environment information which each includes national information. That is, in the memory unit 20 is stored the usage environment information corresponding to information for various nations, for example, Korea, the United States of America, France, China or Germany. The usage environment information stored in the memory unit 20 may be updated by a service provider or the like.

In this respect, the usage environment information stored in the memory unit 20 basically includes national information. According to an exemplary embodiment of the present invention, the usage environment information includes language information corresponding to the national information, usage characteristics in each nation and/or usage characteristics according to each standard organizations.

The national information may include a name of each nation, for example, Korea, the USA, France, Germany or the like. However, in the case that different operational conditions are required in different regions in the same nation, for example, in an eastern region and a western region in the USA, the national information may be divided into 2 or more groups, for example, USA 1 and USA 2.

The language information depends on the national information. For example, if the national information is Korea, the language information becomes Korean, and if the national information is France, the language information becomes French. However, in such a nation as the USA where different languages are used, the language information corresponding to the national information may have a plurality of languages, such as English, Spanish and Chinese.

The usage characteristics in each nation may include a climatic condition and a cultural condition. The climatic condition may include rainfall and snowfall; and the cultural condition may include a life style or the like. For example, if the national information is Korea, the cultural condition may include Kimchi; and if the national information is France, the cultural condition may include a long vacation. A temperature range in the storage room 5 may be predetermined according to the above-described usage characteristics in each nation.

The usage characteristics according to the standard organization may include standards or regulations of standard organizations such as International Organization for Standardization (ISO), Minimum Energy Performance Standards (MEPS), Association of Home Appliance Manufacturers (AHAM) or the like. The usage characteristics according to the standard organization may include a regulation range for noises, a regulation range for electromagnetic waves, a regulation range for power consumption or the like, for operation of the refrigerator 1. An operational condition such as operation time of a compressor driving part 62, a fan driving part 64 and a damper driving part 66 which are included in the operational unit 60 (to be described later) is preset in consideration of the above-described usage characteristics according to the standard organization.

Figure 3:
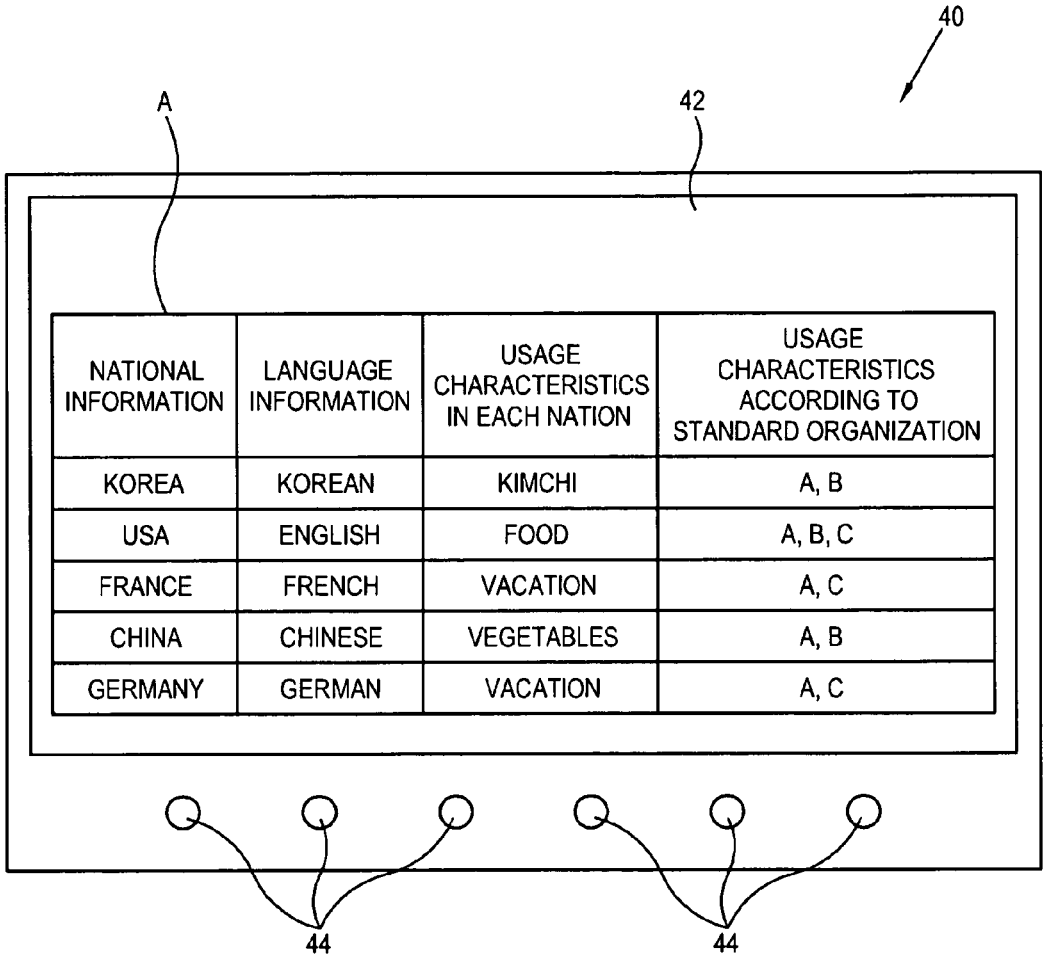
FIG. 3 schematically illustrates usage environment information of a refrigerator according to the first exemplary embodiment of the present invention.
Figure 4:
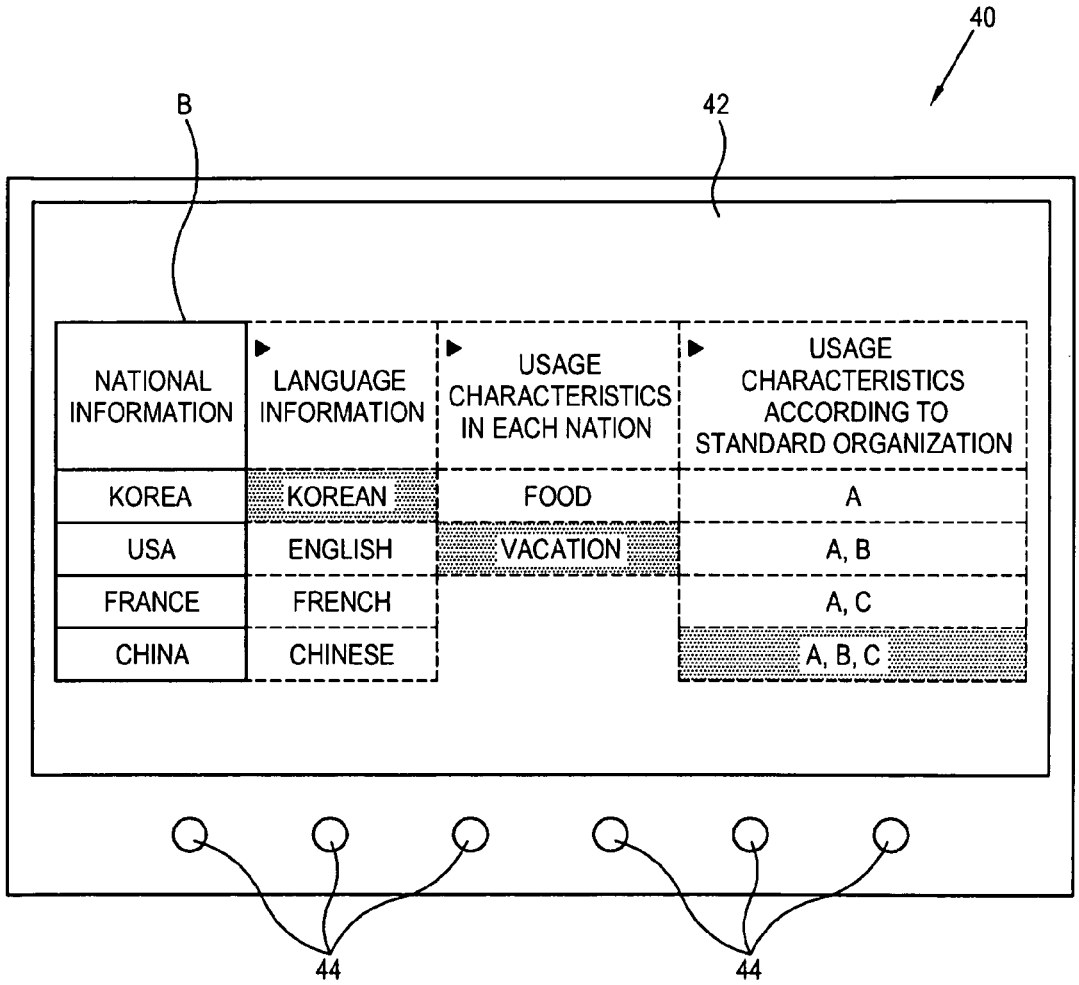
FIG. 4 schematically illustrates usage environment information of a refrigerator according to a second exemplary embodiment of the present invention.

As shown in FIGS. 3 and 4, the selection unit 40 includes a display 42 which displays a plurality of usage environment information stored in the memory unit 20; and an input part 44 through which at least one of the plurality of usage environment information displayed on the display 42 is selectively inputted. The selection unit 40 provides the plurality of usage environment information stored in the memory 20 through the display 42, so that at least one of the usage environment information is selectively inputted through the input part 44.

Referring to FIG. 3, the refrigerator 1 according to an exemplary embodiment of the present invention includes usage environment information as follows.

The plurality of usage environment information is displayed on the display 42 as a code matrix A. That is, the language information corresponding to the national information, usage characteristics in each nation and usage characteristics according to each standard organization collectively form the usage environment information. Then, for example, if the USA is selected through the input part 44, language information relating to the USA, usage characteristics in the USA and usage characteristics according to standard organizations in the USA are applied to the refrigerator for operation.

Referring to FIG. 4, the refrigerator 1 according to another exemplary embodiment of the present invention includes usage environment information as follows.

The plurality of usage environment information is displayed on the display 42 as a code matrix B which is different from the code matrix A shown in FIG. 3.

According to the code matrix B, initially, only national information is provided as the usage environment information. If one of the plurality of usage environment information is selected, the language information may be displayed; if the language information is selected, the usage characteristics in each nation are displayed; and then if the usage characteristics in each nation are selected, the usage characteristics according to the standard organization are selected. That is, in the code matrix B, the national information, the language information, the usage characteristics in each nation, and the usage characteristics according to the standard organization may be sequentially displayed and selectively inputted.

In other words, in the code matrix A in FIG. 3, the language information, the usage characteristics in each nation and the usage characteristics according to the standard organization are selected as a group, according to the national information; but in the code matrix B in FIG. 4, the language information, the usage characteristics in each nation and the usage characteristics according to the standard organization may be selectively inputted after selecting the national information.

The usage environment information is set by a user or a manufacturer of the refrigerator 1 through the selection unit 40. The user may set usage environment information corresponding to a nation where the refrigerator 1 is used, so as to operate the refrigerator 1. For example, when the user moves to a foreign country, the user may set the usage environment information from national information corresponding to the foreign country, thereby improving operational efficiency of the refrigerator 1.

Further, when the manufacturer exports the refrigerator 1 to a foreign country, the manufacturer may set the usage environment information from national information corresponding to the foreign country.

According to the present embodiment, the operational unit 60 includes the compressor driving part 62 which provides a driving force to the compressor 9; and the fan driving part 64 which provides a driving force to the fan 15; and the damper driving part 66 which provides a driving force to the damper 17.

The operational unit 60 is operated according to setting of the usage environment information of the user or the manufacturer. For example, the operational unit 60 provides or blocks a driving force to the compressor 9, the fan 15 and the damper 17, so as to meet a preset temperature range in the storage room 5 according to the usage environment information corresponding to the selected national information.

The controller 80 controls the operational unit 60 to correspond to the operational condition preset according to the usage environment information based on the usage environment information selected through the selection unit 40. More specifically, the controller 80 may control the operational unit 60 to maintain the preset temperature range in the storage room 5 according to the usage characteristics in each nation, and may control the operational unit 60 to meet a preset noise regulation according to the usage characteristics according to the standard organization. Further, the controller 80 controls the display 42 to display a language preset according to language information.

Hereinafter, a method of operating the refrigerator 1 according to an exemplary embodiment of the present invention will be described.

In this respect, it is assumed that the usage environment information is selected by a user of the refrigerator 1.

Figure 5:
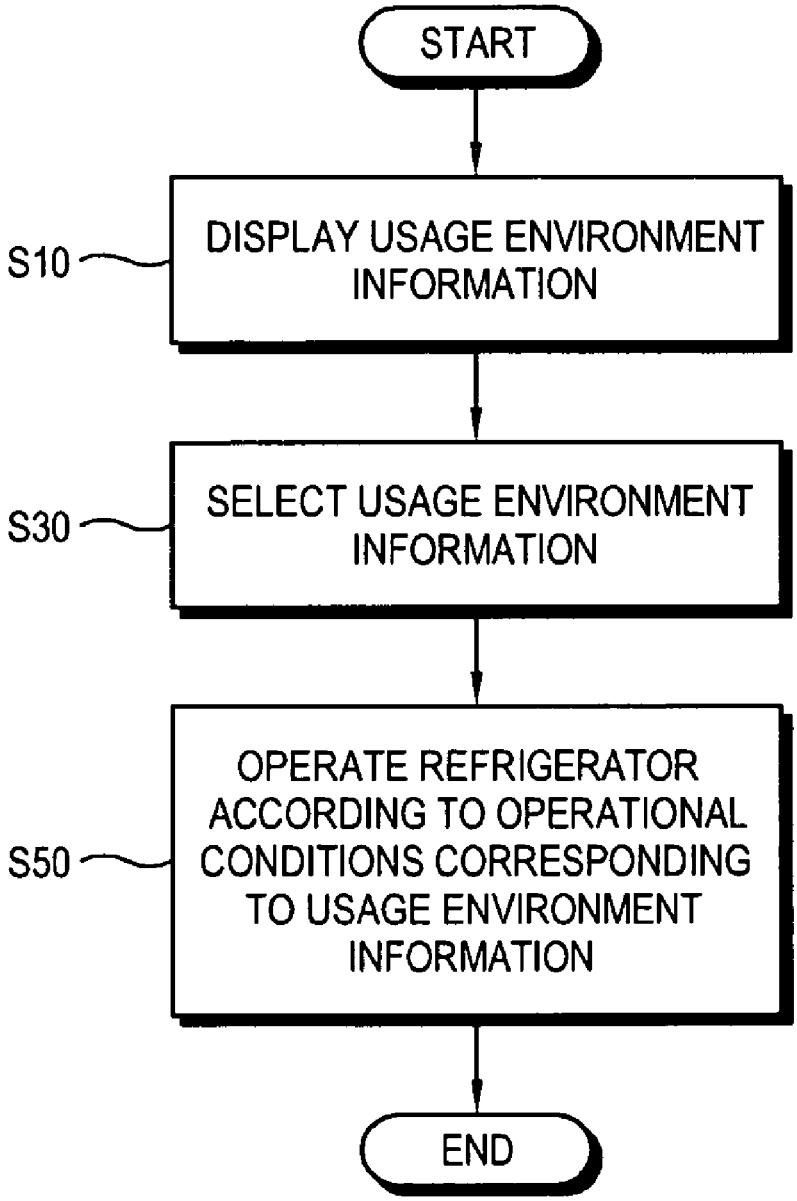
FIG. 5 is a control flowchart illustrating a refrigerator according to an exemplary embodiment of the present invention.

As shown in FIG. 5, according to an operating method of the refrigerator 1 according to an exemplary embodiment of the present invention, a user who moved to a foreign country manipulates the input part 44 so that an operational condition of the refrigerator 1 is set corresponding to the foreign country, and the plurality of usage environment information stored in the memory unit 20 is displayed on the display 42 (S10). The plurality of usage environment information is displayed as the code matrix A.

Then, the user selects user environment information corresponding to the national information (S30). For example, if the foreign country is the USA, the user selects the USA from the national information.

Then, the refrigerator 1 is operated according to user environment information having language information, usage characteristics and usage characteristics according to each standard organization, preset depending on the selected national information (S50). For example, if the USA is selected from the national information, English is displayed and a temperature range in the storage room 5 is set to be suitable for storing food, for example frozen food, and the operational unit 60 is controlled to meet a standards or regulation of a standard organization.

Figure 6:
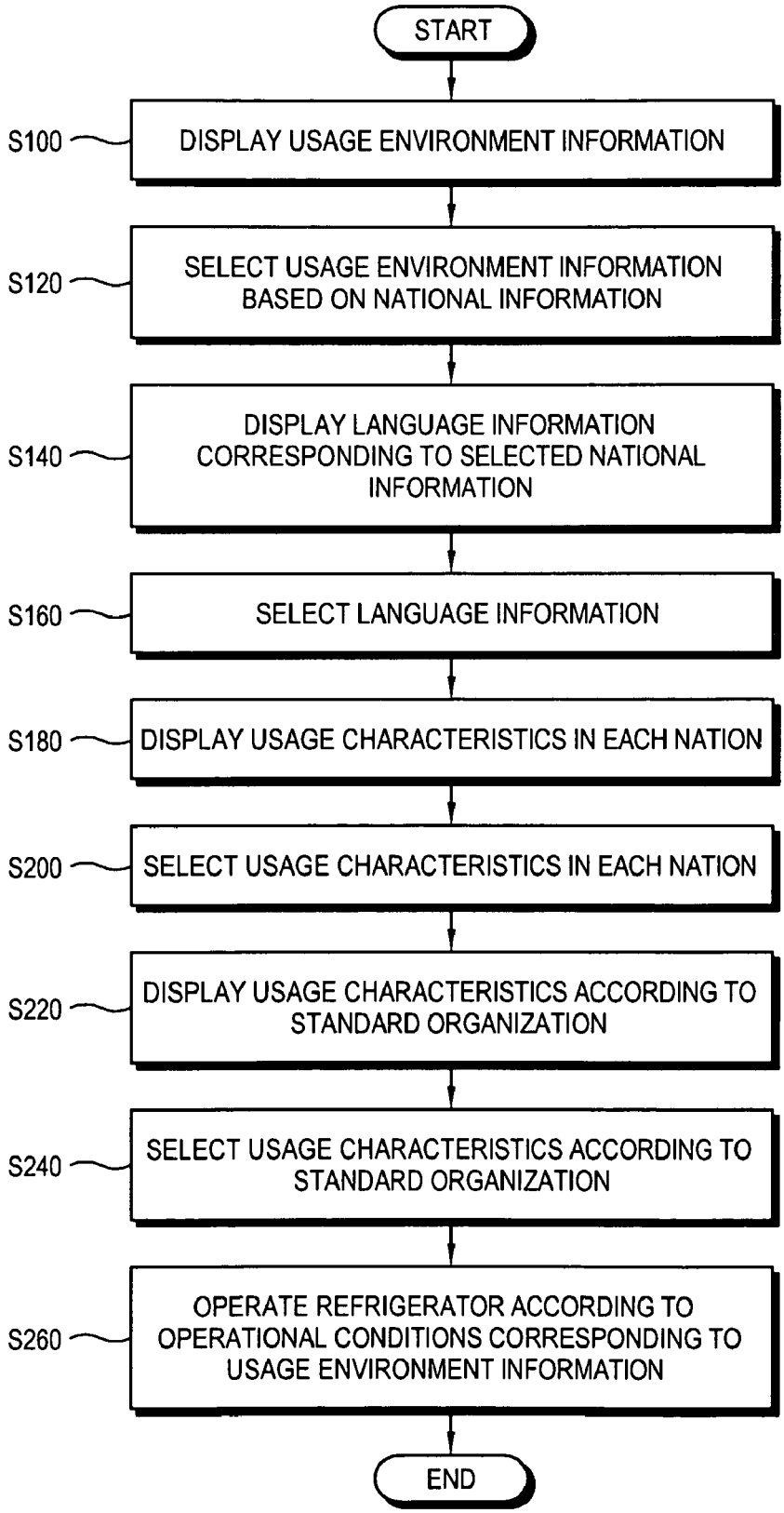
FIG. 6 is a control flowchart illustrating a refrigerator according to another embodiment of the present invention.

As shown in FIG. 6, according to an operating method of a refrigerator 1 according to another exemplary embodiment of the present invention, a user manipulates the input part 44 to display the plurality of usage environment information stored in the memory unit 20 (S100). In this respect, the plurality of usage environment information is displayed as the code matrix B.

The usage environment information is selected based on the national information (S120). For example, the code matrix B displays only national information as the usage environment information; and then a user may select the USA from the national information.

If the usage environment information is selected based on the national information, language information according to the selected national information is displayed (S140). That is, if the USA is selected, English, Spanish, Korean and Chinese may be displayed as a popup.

The user selects one language among the language information (S160). For example, the user may select English. If the language information is selected, usage characteristics in the nation are displayed (S180). In this respect, the usage characteristics in the nation may include the kind of food, a characteristic of a vacation, or the like. Then, the user selects at least one of the usage characteristics in the nation (S200). For example, the user may select the vacation.

If the usage characteristics in the nation are selected, usage characteristics according to the standard organization are displayed (S220). The user selects at least one of the displayed usage characteristics according to the standard organization (S240).

Then, the refrigerator 1 is operated by the usage environment information sequentially selected after selecting the national information (S260).

As described above, according to the embodiment of the present invention, usage environment information can be set corresponding to each nation, thereby improving operational efficiency of the refrigerator.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A method of operating a refrigerator, comprising:

providing a plurality of usage environment information which comprises national information;

selecting the usage environment information corresponding to a nation or region where the refrigerator is used among the plurality of usage environment information; and controlling operation of the refrigerator based on the selected usage environment information;

controlling a driving force of at least one of an operation units of the refrigerator to maintain a preset temperature range in a storage corresponding to the selected usage environment information;

wherein usage environment information comprises a plurality of selectable options that includes at least one a climate condition and at least one a cultural condition.

2. The method according to claim 1, wherein the refrigerator comprises a display, and wherein the providing the usage environment information comprises displaying the usage environment information on the display.

3. The method according to claim 1, wherein the usage environment information further comprises one of language information corresponding to the national information, usage characteristics corresponding to the national information and usage characteristics according to respective standard organizations.

4. The method according to claim 3, further comprising selecting the usage environment information by a user or a manufacturer of the refrigerator.

5. The method according to claim 1, wherein the usage environment information further comprises language information corresponding to the national information, usage characteristics corresponding to the national information and usage characteristics according to respective standard organizations.

6. The method according to claim 5, wherein the selecting the usage environment information comprises selecting the national information and selecting at least one of the language information, the usage characteristics corresponding to the national information and the usage characteristics according to the respective standard organizations, after the selecting the national information.

7. The method according to claim 6, further comprising providing the language information after the selecting the national information.

8. The method according to claim 5, further comprising selecting the usage environment information by a user or a manufacturer of the refrigerator.

9. The method according to claim 5, wherein the refrigerator further comprises a body cabinet which forms a storage room, and the controlling operation of the refrigerator comprises controlling an operation of the refrigerator to correspond to a temperature range in the storage room preset corresponding to the usage characteristics in each nation.

10. The method according to claim 5, wherein the controlling operation of the refrigerator comprises controlling operation of the refrigerator to correspond to standards of electromagnetic waves, noises and power consumption preset corresponding to the usage characteristics according to each standard organization.

11. The method according to claim 1, wherein the operation units comprise at least one of a compressor, a fan and a damper.

12. A refrigerator comprising:

a memory unit which stores a plurality of usage environment information which comprises national information;

a selection unit which provides the plurality of usage environment information stored in the memory unit, and through which at least one of the plurality of the usage environment information is selected;

operational units; and a controller which controls a driving force of at least one of the operation units of the refrigerator to maintain a preset temperature range in a storage corresponding to the selected usage environment information;

wherein the plurality of usage environment information includes at least one a climate condition and at least one a cultural condition.

13. The refrigerator according to claim 12, wherein the usage environment information further comprises one of language information corresponding to the national information, usage characteristics corresponding to the national information and usage characteristics according to respective standard organizations.

14. The refrigerator according to claim 13, wherein the selection unit comprises:

a display which displays the plurality of usage environment information which is stored in the memory unit; and an input part through which one of the plurality of usage environment information displayed on the display is selectively inputted.

15. The refrigerator according to claim 13, wherein the usage environment information is selected by a user or a manufacturer of the refrigerator.

16. The refrigerator according to claim 12, wherein the usage environment information further comprises language information corresponding to the national information, usage characteristics corresponding to the national information and usage characteristics according to respective standard organizations.

17. The refrigerator according to claim 16, wherein after selecting the national information, at least one of the language information, usage characteristics corresponding to the national information and usage characteristics according to the respective standard organizations is selected.

18. The refrigerator according to claim 16, wherein the language information is provided as language information after selecting the national information.

19. The refrigerator according to claim 16, further comprising a body cabinet which forms a storage room, wherein the controller controls the operational unit to correspond to a temperature range in the storage room preset corresponding to the usage characteristics corresponding to the national information.

20. The refrigerator according to claim 16, wherein the controller controls the operational unit to correspond to standards of electromagnetic waves, noises and power consumption preset corresponding to the usage characteristics according to the standard organizations.

21. The refrigerator according to claim 12, wherein the operation units comprise at least one of a compressor, a fan and a damper.

* * * * *